US009787013B2

(12) United States Patent
Sasaki et al.

(10) Patent No.: US 9,787,013 B2
(45) Date of Patent: Oct. 10, 2017

(54) CONNECTOR HAVING A MOVING PLATE

(71) Applicant: Tyco Electronics Japan G.K., Kanagawa (JP)

(72) Inventors: Yoichi Sasaki, Kanagawa (JP); Makiya Kimura, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 15/141,273

(22) Filed: Apr. 28, 2016

(65) Prior Publication Data

US 2016/0322730 A1 Nov. 3, 2016

(30) Foreign Application Priority Data

Apr. 28, 2015 (JP) ..... 2015-091237

(51) Int. Cl.

| | |
|---|---|
| ***H01R 13/15*** | (2006.01) |
| ***H01R 13/193*** | (2006.01) |
| ***H01R 12/89*** | (2011.01) |
| ***H01R 13/6581*** | (2011.01) |
| ***H01R 43/26*** | (2006.01) |
| *H01R 24/60* | (2011.01) |

(52) U.S. Cl.

CPC ..... *H01R 13/193* (2013.01); *H01R 12/89* (2013.01); *H01R 13/6581* (2013.01); *H01R 43/26* (2013.01); *H01R 24/60* (2013.01)

(58) Field of Classification Search

CPC ..... H01R 12/82; H01R 12/88

USPC ..... 439/259, 260, 266, 342, 376

See application file for complete search history.

(56) References Cited

U.S. PATENT DOCUMENTS 5,456,613 A * 10/1995 McHugh ..... H05K 7/1007 439/266

2014/0127922 A1* 5/2014 Sasaki ..... H01R 13/187 439/259

FOREIGN PATENT DOCUMENTS

| | | | |
|---|---|---|---|
| EP | 2731199 | A1 | 5/2014 |
| JP | 4144082 | A | 5/1992 |
| JP | 201496249 | A | 5/2014 |
| JP | 2015091237 | | 4/2015 |
| WO | 9713300 | A1 | 4/1997 |

OTHER PUBLICATIONS

European search report, dated Sep. 1, 2016, 8 pages.

* cited by examiner

*Primary Examiner* — Phuong Dinh

(74) *Attorney, Agent, or Firm* — Barley Snyder

(57) ABSTRACT

A connector comprises a housing, a plurality of contacts, a slide plate, and a moving plate. The contacts are configured to make contact with a plurality of contact pads of a mating connector. The slide plate has a cam face composed of a pattern of projections and recesses and expanding in a direction intersecting with the mating direction. The moving plate expands in an overlapping manner with the slide plate and receives an action of the cam face caused by the sliding of the slide plate. The moving plate moves toward the mating connector and pushes the contacts onto the contact pads of the mating connector.

6 Claims, 14 Drawing Sheets

CONNECTOR HAVING A MOVING PLATE

CROSS-REFERENCE TO RELATED APPLICATIONS

This application claims the benefit of the filing date under 35 U.S.C. §119(a)-(d) of Japanese Patent Application No. 2015-091237, filed Apr. 28, 2015.

FIELD OF THE INVENTION

The present invention relates to a connector and, in particular, to a connector provided with a mechanism for pressing a plurality of contacts onto contact pads of a mating connector, the pressing operation performed with desirably consistent force.

BACKGROUND

Conventionally, a connector having a structure where its contacts are pressed toward contact pads of a mating connector at a final stage of mating with the mating connector or after being mated with the mating connector is used. In a case of the connector of this type, since the contacts are in a non-contact state before the final stage, a force required for the mating can be reduced.

As one example of the connector of this type, a connector having a receiving portion receiving a plate-shaped insertion portion of a mating connector is disclosed by Sasaki in US2014/0127922A1. In the plate-shaped insertion portion, a first face thereof is formed with contact pads. When the insertion portion is inserted into the receiving portion, a slider having a cam face is driven at the final stage of the insertion by pressing the insertion portion. Contacts are pressed on the contact pads of the insertion portion by the slider.

In the case of the connector disclosed by Sasaki in US2014/0127922A1, however, individual contacts are pressed on the contact pads by individual cam faces. Therefore, a problem arises in that variations tend to occur regarding quality and uniformity of contact (contact pressure or contact timing) due to variations of individual cam faces or a warpage of the slider.

Further, as another example of the connector of the above-described type, there is a connector disclosed by Ishikawa et al. in JP278211B2 (JPH-04-144082A). In this connector, a cam member and a cam rail member are arranged so as to overlap with each other. The cam member drives the cam rail member causing a plurality of contact pieces to make contact with a plurality of conductors simultaneously.

In the case of the aforementioned connector, however, the number of the contact pieces which can be caused to make contact with the conductors to be contacted by a single cam rail member is up to, at most, two rows of the contact pieces. That is, in the case of this connector, contacts widely arranged in a two-dimensional fashion cannot be caused to make contact with contact pads arranged on one face in a two-dimensional fashion simultaneously.

SUMMARY

In view of the above, a connector is provided which causes a plurality of contacts to make contact with a plurality of contact pads arranged on a mating face of a mating connector in a two-dimensional fashion simultaneously with a high degree of contacting quality using a desirably consistent and uniform force.

A connector of the present invention is characterized by including a housing configured to be mated with a mating connector having a plurality of contact pads arranged on a mating face expanding in a direction intersecting with a mating direction in a two-dimensional fashion. The connector is further characterized by a plurality of contacts arranged in a two-dimensional fashion and configured to make contact with the plurality of contact pads of the mating connector, respectively. A slide plate is provided having a cam face composed of a pattern of projections and recesses and expanding in a direction intersecting with the mating direction and is slid in a lateral direction intersecting with the mating direction according to a driving operation. The connector is further characterized by a moving plate expanding in an overlapping manner with the slide plate, receiving an action of the cam face caused by the sliding of the slide plate according to the above-described driving operation to move toward the mating connector and pushing the plurality of contacts onto the plurality of contact pads of the mating connector.

The connector of the present invention is provided with the slide plate having the cam face, and the moving plate moving in response to the sliding of the slide plate to push the plurality of contacts onto the plurality of contact pads of the mating connector. Therefore, variations in the quality or uniformity of contacting are made smaller by the connector according to the present invention so that higher quality contacting is realized than that achieved by the configuration of directly driving the contacts by the cam face like the connector disclosed by Sasaki in US2014/0127922A1. Further, according to the structure of the present invention, the number of contact pieces is not limited to at most two rows like the connector disclosed in Ishikawa et al. in JP278211B2 (JPH-04-144082A). That is, according to the connector of the present invention, a plurality of contacts arranged in a two-dimensional fashion (an array) can be caused to make contact with a plurality of contact pads arranged on a mating face in a two-dimensional fashion simultaneously by one moving plate. Incidentally, the term "two-dimensional fashion" in this specification includes such a case that rows or columns of elements adjacent to each other are staggered to each other in addition to a case, for example, where the elements are arranged in a matrix (array) shape.

Here, in the connector of the present invention, it is preferable that a lock plate sliding in a lateral direction intersecting with the mating direction to fix a mating position of the mating connector to the housing according to the above-described driving operation is further provided.

By providing this lock plate, the mating position of the mating connector is fixed.

Thereby, contact pressures of the contacts to the contact pads are made stable.

Further, in the case where the above-described lock plate is provided, it is preferable that a cam member having a first cam portion sliding the lock plate to lock the mating connector according to the above-described driving operation and a second cam portion sliding the slide plate to move the moving plate according to the above-described driving operation to push the plurality of contacts onto the plurality of contact pads of the mating connector after the locking of the mating connector performed by the lock plate is further provided.

By providing the cam member, the mating connector is first locked and the contacts next make contact with the contact pads according to one operation. Therefore, both the locking of the mating connector and contacting of the contacts to the contact pads with a stable and uniform contact pressure are performed.

According to the above-described present invention, a plurality of contacts can be caused to make contact with a plurality of contact pads arranged on a mating face of a mating connector in a two-dimensional fashion with a high contacting quality and uniformity simultaneously according to one operation.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

In the following, embodiments of the connectors according to the present invention will be described with reference to the accompanying drawings shown in FIGS. 1 to 15 in which like numbers are used to refer to like elements.

Figure 1:
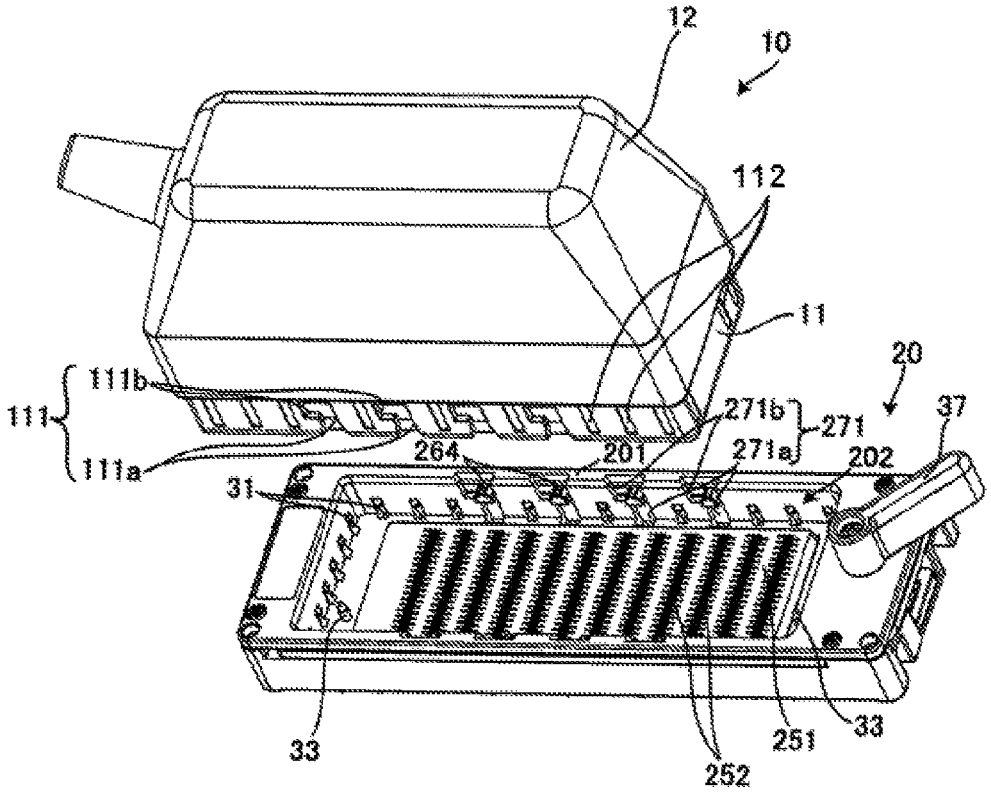
FIG. 1 is a perspective view of a first connector and a second connector to be mated with each other, the two connectors shown before mating.

Now with reference to FIG. 1, a first connector 10 and a second connector 20 according to the present invention are shown before being mated with each other.

Figure 2:
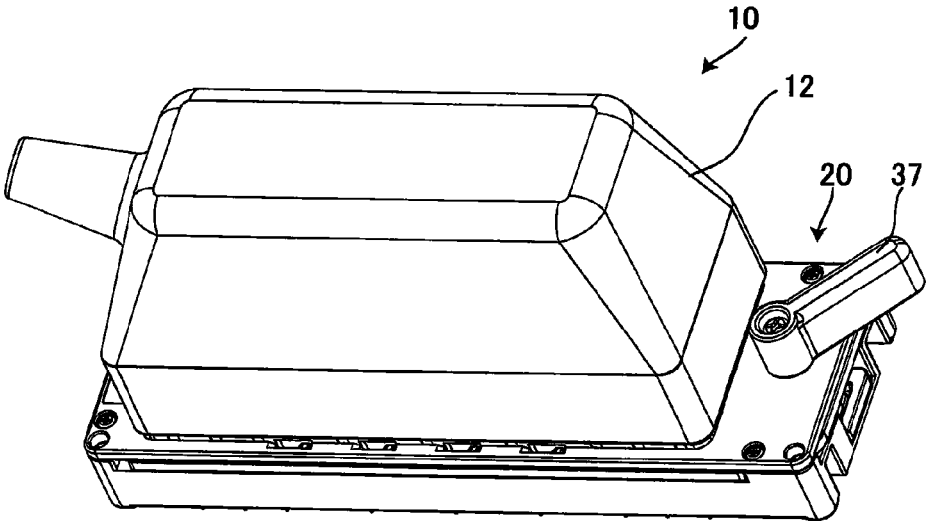
FIG. 2 is a perspective view showing the first connector and the second connector shown in FIG. 1 in a mating state.

Further, with reference to FIG. 2, the first connector 10 and the second connector 20, first shown in FIG. 1, are shown in a state after being mated together.

After mating the first connector 10 with the second connector 20 as shown in FIG. 2, a lever 37 (provided in the second connector 20) is rotationally operated. Details of this operation and its effect will be described later.

The first connector 10 has a shape where a large cap 12 made of resin has been attached onto a frame 11 made of metal. A cable (not shown) composed of many electric wires is connected within the cap 12. On one hand, the second connector 20 has a recess-shaped mating portion 202 whose periphery is surrounded by a wall 201 on a side facing the first connector 10. The second connector 20 is fixed and connected to an apparatus (not shown). As shown in FIG. 2, the first connector 10 is mated with the second connector 20 such that a front end thereof facing the side of the second connector 20 is fitted into a recess-shaped mating portion 202 of the second connector 20.

Figure 4A:
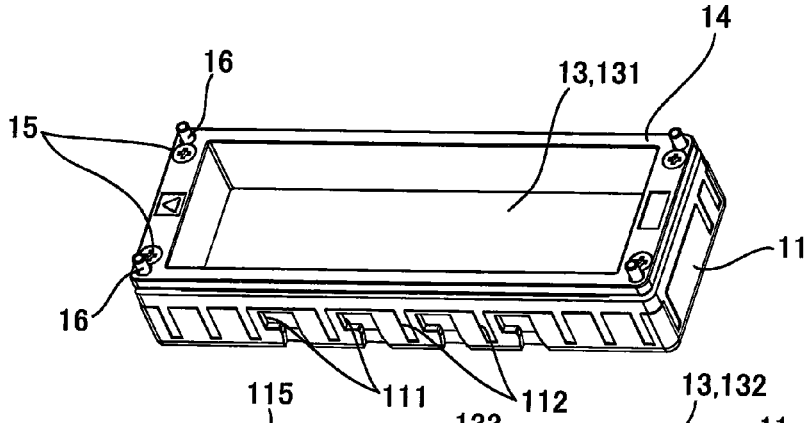
FIG. 4 shows perspective views illustrating respectively an upper face side (FIG. 4(A)) and a lower face side (FIG. 4(B)) of the first connector.
Figure 4B:
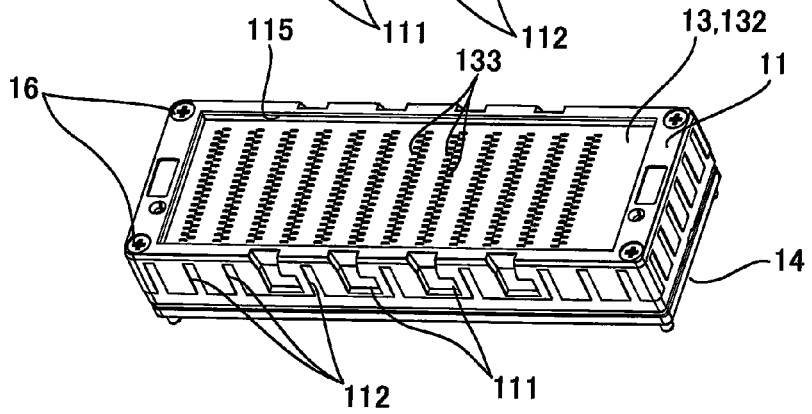

Here, the first connector 10 is formed with many connection pads 133 (see FIG. 4(B)) arranged on a mating face facing the side of the second connector 20 in a two-dimensional fashion (in an array). When the first connector 10 is mated with the second connector 20, the mating face of the first connector 10 faces a mating face 251 of the second connector 20 in a state approximately contacting with the mating face 251 of the second connector 20. The mating face 251 of the second connector 20 is a bottom face of the recess-shaped mating portion 202 whose periphery is surrounded by the wall 201. Many holes 252 are formed in the mating face 251.

Contacts 221 (described later) are arranged in the many holes 252 of the mating face 251, the holes positioned on the same face as the mating face 251 or at a height slightly recessed from the mating face 251. The first connector 10 is mated with the second connector 20 so as to be put in a state shown in FIG. 2 and the lever 37 is rotationally operated. Thereby, according to the rotational operation, the contacts 221 are moved to project from the many holes 252 formed in the mating face 251 of the second connector 20 and to make contact with the contact pads 133 of the first connector 10. However, the contacts 221 elastically deform when they make contact with the contact pads 133. Therefore, actually, the contacts 221 hardly project from the holes 252 and are put in a state where they make contact with the contact pads 133 with a predetermined contact pressure.

Further, the frame 11 of the first connector 10 is formed with a plurality of lock grooves 111 on its outer face facing the side of the second connector 20.

The lock groove 111 is an L-shaped groove having a first portion 111*a* opened toward an end portion of the second connector 20 side to extend in the mating direction and a second portion 111*b* extending laterally on a depth side of the first portion 111*a*.

Further, the second connector 20 is also formed with a plurality of L-shaped lock grooves 271 in a portion thereof positioned inside the wall 201. The lock groove 271 of the second connector 20 also has a first portion 271*a* extending in the mating direction (facing a depth of the recess) and a second portion 271*b* extending laterally so as to be wholly formed in an "L" shape. However, the second portion 271*b* is formed on an upper end side of the first portion 271*a* to be opened upward (on the side of the first connector 10). Further, the second connector 20 has a plurality of lock projections 264 projecting inward through the lock grooves 271.

As shown in FIGS. 1, 2, 7, and 10 when the first connector 10 is mated with the second connector 20, the lock groove 111 of the first connector 10 and the lock groove 271 of the second connector 20 face each other so that an L-shaped passage is formed. When the lever 37 is rotationally operated, the lock projection 264 moves laterally in a passage portion formed by the second portions 111*b* and 271*b* extending laterally of the L-shaped passage. Thereby, the first connector 10 is locked to the second connector 20 in an immovable fashion by the lock projection 264.

Further, as shown collectively in FIGS. 1, 5, 6, 9, 12, and 15, a plurality of shield members 31 are arranged on an inner face of a base housing 22 of the second connector 20 over one round. The frame 11 of the first connector 10 and the base housing 22 of the second connector 20 are made of metal. The shield member 31 is provided in the second connector 20 in a contacting state with the base housing 22. Then the first connector 10 is mated with the second connector 20, the shield members 31 provided in the second connector 20 make contact with shield contact portions 112 of the frame 11 of the first connector 10. Thereby, the first connector 10 and the second connector 20 are shielded integrally.

The first connector 10 is mated with the second connector 20 as shown in FIG. 2 and the lever 37 is rotationally operated. Thereby, the lock projection 264 first starts moving laterally to lock the first connector 10. Next, the contact 221 rises from the hole 252 of the mating face 251 of the second connector 20. The contact 221 which has risen is pushed onto the contact pad 133 formed on the mating face of the first connector 10 at a position facing the mating face 251 of the second connector 20.

Further, post pins 33 project from both sides of the mating face 251 of the second connector 20 in the longitudinal direction. When the first connector 10 is mated with the second connector 20, these two post pins 33 are put in a state where they have been plugged into locating holes 136 (see FIG. 3) provided in the first connector 10. Both of these two post pins 33 are provided near the same side of the mating face 251 in the widthwise direction (a near side in FIG. 1). Therefore, the first connector 10 cannot be mated with the second connector 20 in the wrong direction in the longitudinal direction, so that mating is made possible only in the direction shown in FIG. 1 and FIG. 2.

The first connector 10 will be first explained in detail, the second connector 20 will be next explained in detail, and an operation performed at the time of the mating of the first connector 10 and the second connector 20 will be then explained in detail.

Now referring to FIG. 3, the first connector 10 is provided with a circuit board 13 and a retainer 14 in addition to the frame 11 and the cap 12 which have been explained with reference to FIG. 1 and FIG. 2.

Figure 3:
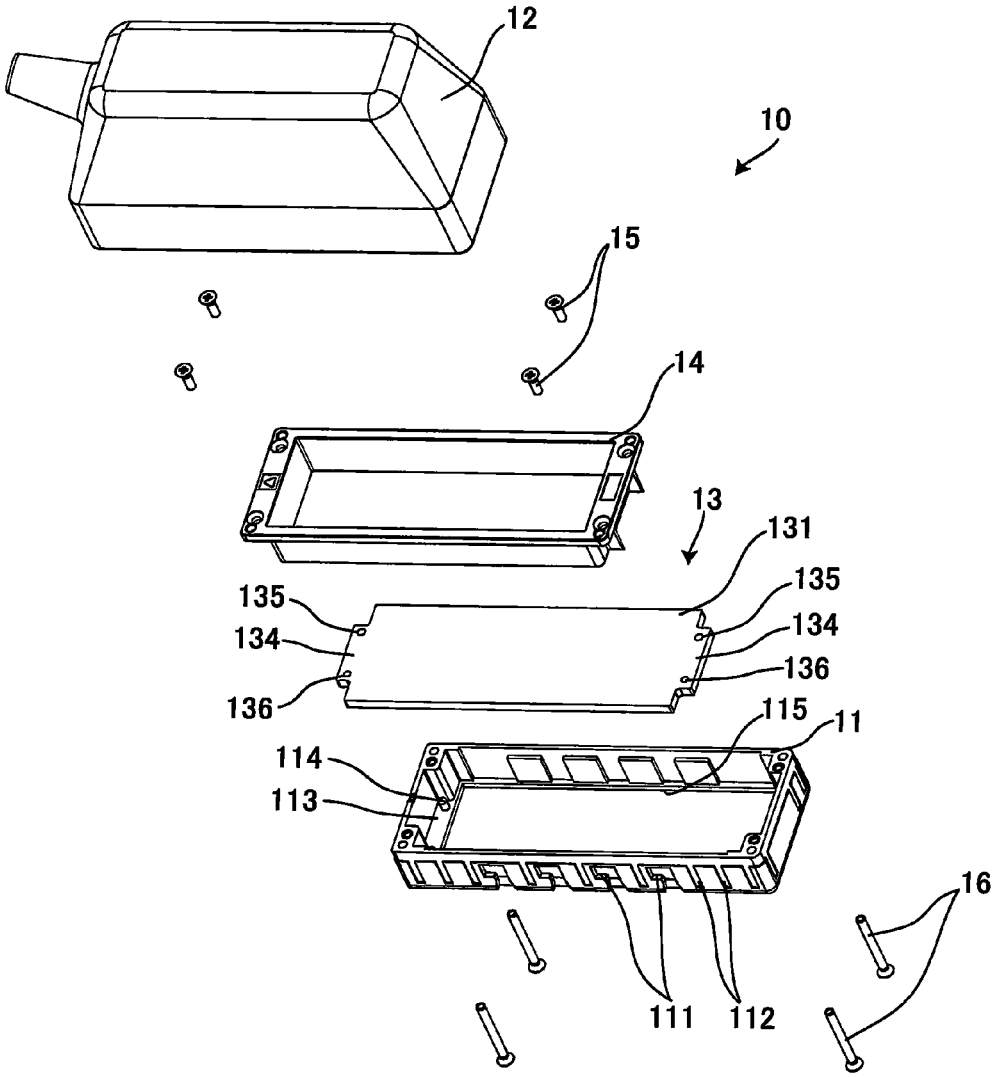
FIG. 3 is an exploded perspective view of the first connector.

Fixing of respective parts constituting the first connector 10 is performed by four short screws 15 and four long screws 16 as shown in FIG. 3.

The frame 11 is made of metal, as described above, and it is provided with a plurality of lock grooves 111 and shield contact portions 112 on an outside face thereof.

Further, many contact pads 133 are arranged in the circuit board 13 on a lower face 132 (see FIG. 4(B)) facing in the opposite direction to an upper face 131 shown in FIG. 3 in a two-dimensional fashion. The lower face 132 of the circuit board 13 is the mating face of the first connector 10 to the second connector 20.

Further, the circuit board 13 has tongue portions 134 projecting at left and right sides. Stand portions 113 on which the tongue portions 134 are placed are provided on the frame 11 corresponding to the tongue portions 134. Further, locating holes 135 and 136 are provided in the tongue portion 134 of the circuit board 13. On one hand, locating pins 114 are provided on the stand portion 113 of the frame 11. The locating pins 114 are provided such that one thereof is allocated to each of the left and right stand portions 113, namely the number of the locating pins is totally two. These two locating pins 114 are provided near the same side in the widthwise direction (near the depth in FIG. 3).

Further, a large opening 115 is opened in the frame 11 on a lower face side facing the side of the second connector 20 (see FIGS. 1 and 3).

The circuit board 13 is placed in such a state that the tongue portions 134 have been placed on the stand portions 113 of the frame 11 and the locating pins 114 of the frame 11 have been pushed into the locating holes 135 of the circuit board 13. Thereby, the circuit board 13 is positioned on the frame 11.

Two locating holes 135 and 136 are provided in each of the left and right tongue portions 134. On one hand, the number of locating pins 114 provided on these stand portions 113 is one per each of the respective left and right stand portions 113. The locating pins 114 provided on these stand portions 113 are inserted into respective one left and right locating holes 135 of the two locating holes 135 and the two locating holes 136 in the two left and right tongue portions 134, respectively, so that locating of the circuit board 13 to the frame 11 is performed. The post pins 33 (see FIG. 1) provided on the second connector 20 are plugged into the remaining locating holes 136, which are provided one by one corresponding to the left side and the right side, of the locating holes 135 and 136 which are provided two by two at the left side and the right side upon mating.

Here, the lower face 132 (see FIG. 4(B)) of the circuit board 13 formed with the contact pads 133 make contact with the stand portions 113 of the frame 11 (See FIG. 3), and the lower face 132 is positioned on the frame 11. Therefore, even if variations of thicknesses in the circuit board 13 or the like are present, the contact pads 133 on the circuit board 13 are always positioned on the frame 11 correctly. Therefore, the contacts of the second connector 20 can be caused to make contact with the contact pads 133 on the circuit board 13 of the first connector 10 with a contact pressure which has been adjusted with high precision.

Further, the retainer 14 makes contact with the upper face 131 of the circuit board 13 supported by the frame 11 and fixes the circuit board 13 to the stand portions 113 of the frame 11 in a state that it has been pushed onto the stand portions 113. Thereby, the circuit board 13 is fixed in a state where it has been securely pushed onto the stand portions 113 of the frame 11.

The short screws 15 are screwed to the frame 11 from the side of the retainer 14. Thereby, the retainer 14, the circuit board 13 and the frame 11 are fixed in an integrated fashion.

Further, the long screws 16 are pushed from the side of the frame 11 to fix the cap 12 to the frame 11.

Here, as shown in FIG. 4, the retainer 14 is a frame-shaped member having a through-hole at a central portion thereof. The upper face 131 of the circuit board 13 is opened to the side of the cap 12 through the central portion of the retainer 14. Further, the cap 12 is formed in a dome shape bulging upward. That is, a wide space is formed between the cap 12 and the upper face 131 of the circuit board 13. A required circuit board or the like is accommodated in the wide space in response to an application of a connector assembly composed of the first connector 10 and the second connector 20. Details of this matter are omitted here.

FIG. 4 shows perspective views illustrating an upper face side (FIG. 4(A) of the first connector 1 and a lower face side (FIG. 4(B)) thereof.

In FIG. 1, an appearance of the first connector 10 which has been attached with the cap 12 is shown. In contrast in this FIG. 4, the first connector 10 is shown with the cap 12 detached. In the following text, it is understood that "first connector 10" refers to even the first connector from which the cap 12 has been detached as well as to the first connector 10 to which the cap 12 is attached.

The circuit board 13 is sandwiched between the frame 11 and the retainer 14. The lower face 132 of the circuit board 13 formed with the contact pads 133 positioned in a desired location by the frame 11 with a high precision.

Incidentally, in this embodiment, a configuration obtained by combining the frame 11 and the retainer 14 corresponds to one example of the housing, and the stand portion 113 of the frame 11 corresponds to one example of the positioning/locating portion. Further, the retainer 14 corresponds to one example of the fixing portion of the housing.

Next, the second connector 20 will be explained in detail.

Figure 5:
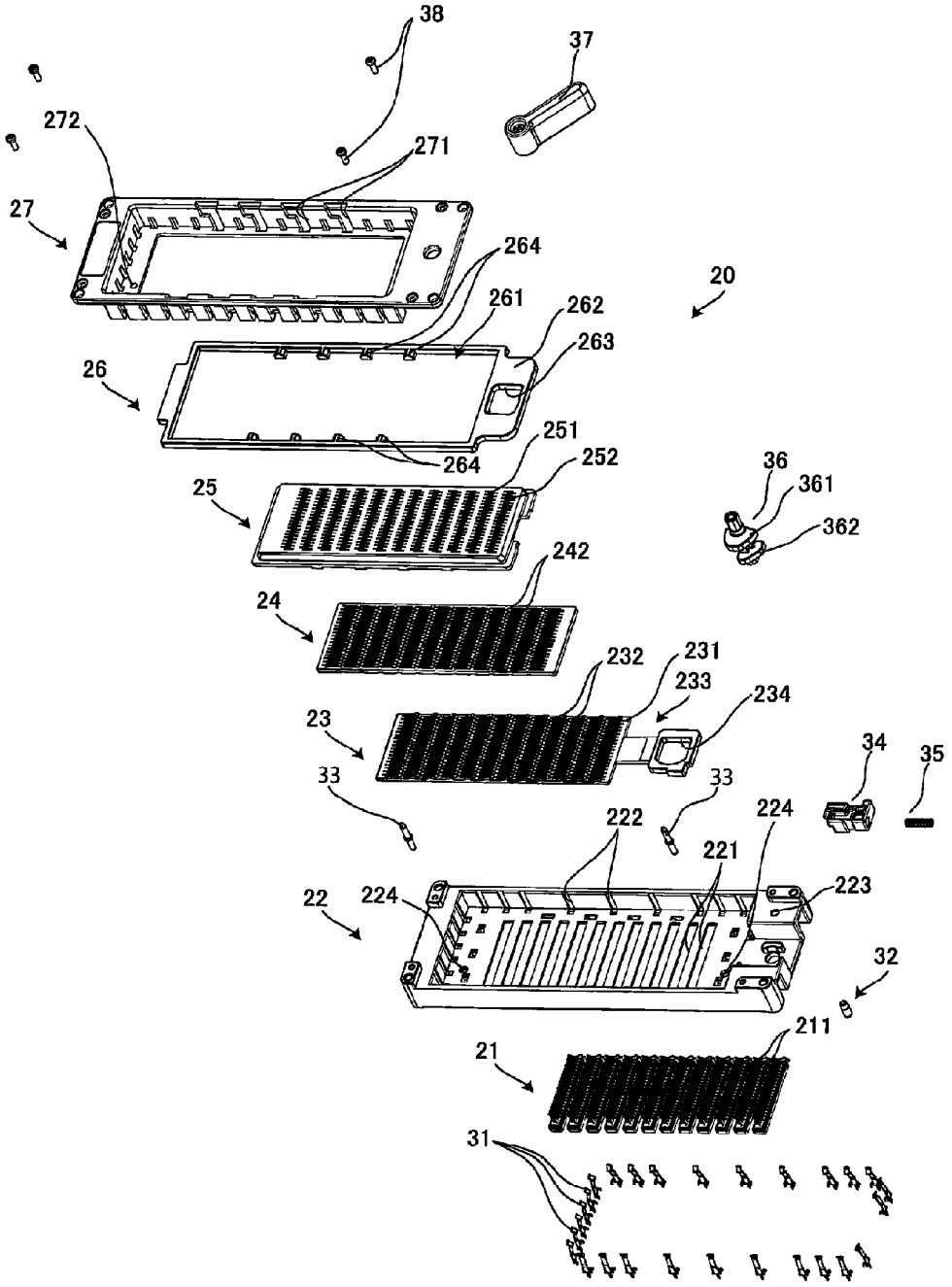
FIG. 5 is an exploded perspective view of the second connector.

FIG. 5 is an exploded perspective view of the second connector.

The second connector 20 has the following as major components: contact blocks 21, the base housing 22, a slide plate 23, a lift plate 24, an upper housing 25, a lock plate 26, and a shell 27.

A plurality of (here, for example, 12 pieces) contact blocks 21 are provided.

Many contacts 221 insert-molded are arranged in each contact block 21.

The base housing 22 is formed in a rectangular shape in a plan view, and it has a shape where it is surrounded by a wall and is recessed at a central portion thereof. Twelve elongated holes 211 are formed on a recess-shaped bottom face. Each contact block 21 is press-fitted into each elongated hole 211 from a back face side of the base housing 22, and the contacts 221 are arranged inside the base housing 22 through the elongated holes 211.

Further, the slide plate 23 and the lift plate 24 are arranged in the recessed portion of the base housing 22 from above the base housing 22, and the upper housing 25 is further placed on the lift plate 24. The slide plate 23 and the lift plate 24 are formed with many holes 232 and 243 for allowing penetration of many contacts 221. Many holes 252 (for allowing penetration of the contacts 221) are also formed in the upper housing 25. Uppermost portions of the contacts 221 enter the holes 252 of the upper housing 25. However, in a state where a force is not applied to the contacts 221, the uppermost portions of the contacts 221 enter the holes 252 of the upper housing 25 and they do not then protruded above the upper housing 25.

The slider 23 has a projecting portion 233 projecting in its longitudinal direction, and the projecting portion 233 is formed with a cam hole 234. A second cam 362 of a cam member 36 (described later) enters the cam hole 234. The slider 23 is pressed in the longitudinal direction to slide by rotation of the cam member 36. Further, an upper face 231 (a face on the side of the lift plate 24) of the slider 23 constitutes a convex cam face.

Further, the lift plate 24 expands so as to overlap with the slider 23. A lower face (facing the upper side of the slider 23) of the lift plate 24 constitutes a cam reception face having a recessed shape corresponding to projection portions 235 (See FIG. 5) on the upper face 231 of the slider 23. The projection portions 235 on the upper face 231 of the slider 23 enter recess portions 244 in the lower face 243 of the lift plate 24. In this state, the lift plate 24 is at a lowered position. When the cam member 36 is rotated, the slider 23 is slid laterally according to an action of the second cam 362. Thereby, the projection portions 235 on the upper face 231 of the slider 23 make contact with recessed portions 244 on the lower face 243 of the lift plate 24 to lift up the lift plate 24. The lift plate 24 lifts up many contacts 221 simultaneously.

In a mating state of the first connector 10, such an arrangement is performed that the mating face of the circuit board 13 (a constituent of the first connector 10, which is the lower face formed with the contact pads 133) overlaps with the mating face 251 (which is the upper face of the upper housing 25). Therefore, in the mating state of the first connector 10, the contacts 221 are forced to project upward from the upper housing 25 to make contact with the contact pads 133 on the lower face 132 of the circuit board 13 of the first connector 10 to elastically deform. Thereby, the contact pads 133 and the contacts 221 are put in a contacting state with each other with a consistent predetermined contact pressure.

Further, the lock plate 26 is arranged above the upper housing 25. The lock plate 26 has a frame shape surrounding a large opening 261, and it is provided with a projecting portion 262 in its longitudinal direction. A cam hole 263 is formed in the projecting portion 262 at a position at which the first cam 361 of the cam member 36 enters. Further, a plurality of lock projections 264 projecting inside the opening 261 are formed in the lock plate 26 (see FIG. 5 together with FIG. 1 where 8 such lock projections 264 are shown).

Further, the shell 27 is arranged so as to enter the opening 261 of the lock plate 26. At this time, the lock projections 264 of the lock plate 26 enter the L-shaped lock grooves 271 provided in the shell 27.

As described above, the L-shaped lock grooves 111 are also formed in the frame 11 (see FIG. 1 and FIG. 3) of the first connector 10. When mating of the first connector 10 is performed as shown in FIG. 2, the lock grooves 111 and 271 of both the first connector 10 and the second connector 20 are superimposed on each other in a facing fashion to each other, where the L-shaped passages are formed. The lock plate 26 is slid laterally according to an action of the first cam 361 when the cam member 36 is rotated. Thereby, the lock projections 264 move in lateral passages composed of the second portions 111*b* and 271*b* of the L-shaped passages composed of both the lock grooves 111 and 271. Thereby, the first connector 10 is locked to the second connector 20.

Further, as shown in FIG. 5, the second connector 20 has many shield members 31, a ball plunger 32, two post pins 33, a lock block 34, a lock block spring 35, a cam member 36, a lever 37, and four screws 38.

The shield members 31 are arranged on the base housing 22 so as to take an attitude or position along shield member arrangement portions 222 provided on the inner side of the wall surrounding the base housing 22. As described above, the shield members 31 make contact with the shield contact portions 112 (see FIGS. 1 and 3) formed on the frame 11 of the first connector 10. Thus, the first connector 10 and the second connector 20 are shielded integrally by these shield members 31.

Further, the ball plunger 32 is plugged into the hole 223 of the base housing 22. The ball plunger 32 makes contact with a back face of the projecting portion 262 of the lock plate 26 after assembled. As described above, the lock plate 26 is slid according to rotation of the cam member 36. Recesses (not shown) are formed in the back face of the projecting portion 262 of the lock plate 26 at two positions at which the ball plunger 32 contacts. These two positions constitute a starting point and an end point of the sliding of the lock plate 26. The ball plunger 32 slightly locks the lock plate 26 at the two positions of the starting point and the end point of the sliding of the lock plate 26 and provides a clicking feeling to a user rotationally operating the lever 37 described later.

Further, the two post pins 33 are plugged into two holes 224 in the bottom portion of the base housing 22, respectively. In addition, the post pins 33 penetrate two holes 272 (here, only one 272 of the holes is shown/visible) provided in the shell 27, and they are put in a protruded state from the mating portion 202 of the second connector 20, as shown in FIG. 1. These two post pins 33 are plugged into the locating holes 136 of the circuit board 13, as described above. Thereby, mating of the first connector 10 in the wrong direction in the longitudinal direction is prevented.

The lock block 34 and the lock block spring 35 are members which perform locking such that the cam member 36 cannot be rotated during non-mating of the first connector 10 and perform unlocking when mating of the first connector 10 is performed.

The lock block 34 and the lock block spring 35 are arranged on the base housing 22. The lock block 34 is pushed by the lock block spring 35 so that a distal end portion 341 of the lock block 34 is put in a protruded state into the recess-shaped mating portion 202 of the second connector 20 (see FIG. 6). In this state, rotation of the cam member 36 is blocked. The first connector 10 is mated with the second connector 20. Thereby, the distal end 341 of the lock block 34 is pushed by the first connector 10 forced to perform mating with retreat from the mating portion 202 while shrinking the length of the lock block spring 35 in a pushing manner. Thereby, the cam member 36 is unlocked so that the cam member 36 is put in a rotatable state.

Further, the cam member 36 has the first cam 361 and the second cam 362, as described above and shown in FIG. 5. The first cam 361 is located in the cam hole 263 of the lock plate 26 and it slides the lock plate 26 according to rotation of the cam member 36. Further, the second cam 362 is located in the cam hole 234 of the slider 23 and it slides the slider 23 according to rotation of the cam member 36.

The lever 37 is screwed to the cam member 36. The lever 37 is rotationally operated by a user. When the lever 37 is rotated, the cam member 36 is also rotated integrally with the lever 37.

Four screws 38 fix the shell 27 to the base housing 22. Thereby, respective parts arranged so as to be sandwiched between the shell 27 and the base housing 22 are fixed.

Here, in the second connector 20, a configuration obtained by combining the base housing 22 and the shell 27 corresponds to one example of the housing. Further, the slider 23 corresponds to one example of the slide plate. In addition, the lift plate 24 corresponds to one example of the moving plate.

Figure 6:
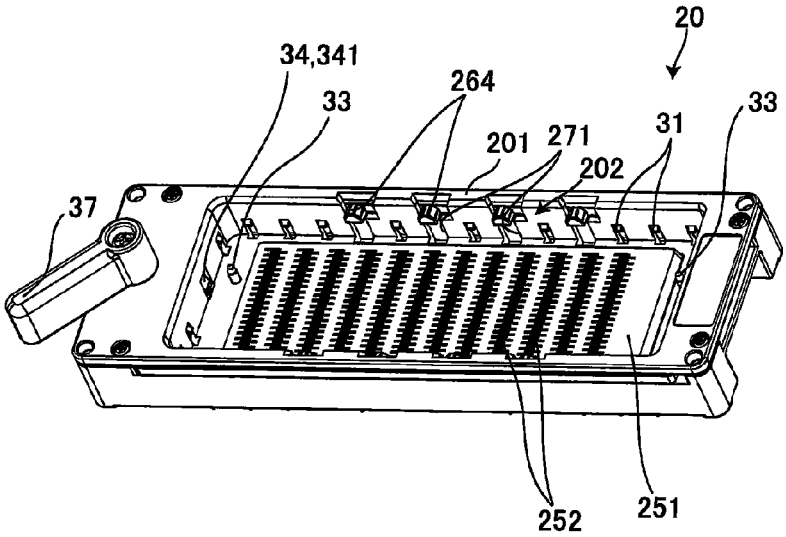
FIG. 6 is a perspective view of the second connector in an assembled state.

FIG. 6 is a perspective view of the second connector in an assembled state. The second connector 20 in the assembled state is also shown in FIG. 1. In this FIG. 6, the second connector 20 is oriented differently than as shown in FIG. 1. In this FIG. 6, the distal end portion 341 of the lock plate 34 which is not shown in FIG. 1 is shown.

Figure 7A:
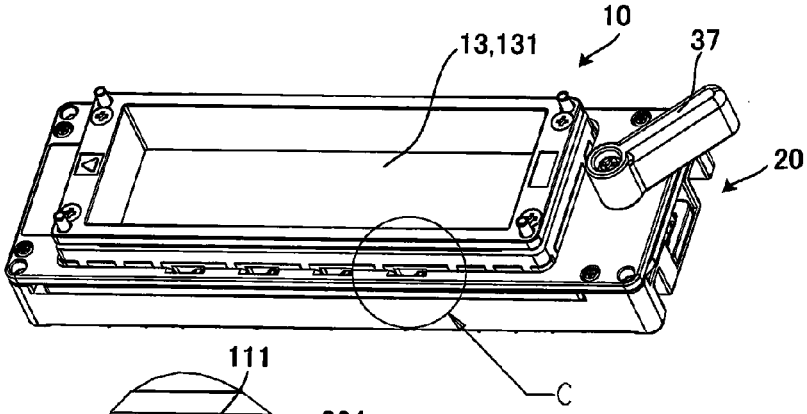
FIG. 7 shows perspective views illustrating respectively (FIG. 7(A)) a state where the first connector and the second connecter have been mated with each other and before a lever is rotationally operated, and (FIG. 7(B)) an encircled partially enlarged view of the state shown in FIG. 7(A)
Figure 7B:
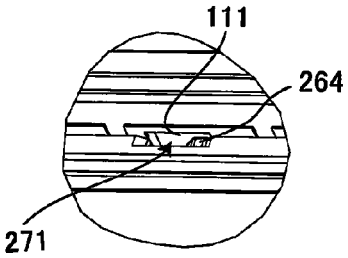

FIGS. 7 and (B)) are a perspective view showing a state where the first connector 10 and the second connector 20 have been mated with each other and before the lever is rotationally operated (FIG. 7(A)) and a partial enlarged view thereof (FIG. 7(B). Here, the enlarged view in FIG. 7(B) is an enlarged view of a portion surrounded by a circle C (shown in FIG. 7(A)). In respective figures subsequent to these FIGS. 7(A) and 7(B), the cap 12 (see FIG. 1 and FIG. 2) of the first connector 10 is omitted, where the upper face 131 of the circuit board 13 is exposed.

In a state before the lever 37 is rotationally operated, which is shown in FIGS. 7(A) and 7(B), the lock projections 264 are located at a position shown in FIG. 7(B) within the lock grooves 271 and 111. When the lock projections 264 are located at this position, the first connector 10 is not locked and it is put in a state detachable from the second connector 20.

Figure 8A:
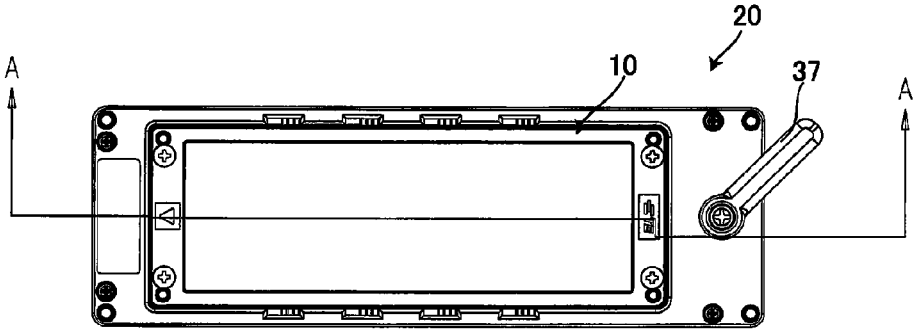
FIG. 8 illustrates a plan view (FIG. 8(A)) of a state before the lever shown in FIG. 7 (FIGS. 7(A) and 7(B)) is rotationally operated, a partially-sectional plan view (FIG. 8(B)) of the state showing a portion in a section, and a vertical sectional view (FIG. 8(C)) thereof.
Figure 8B:
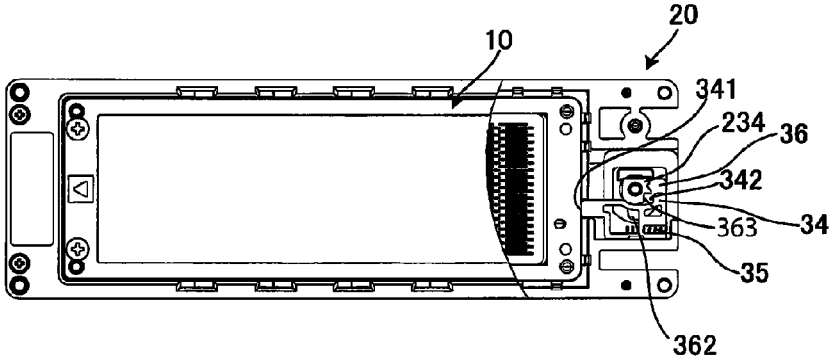
Figure 8C:
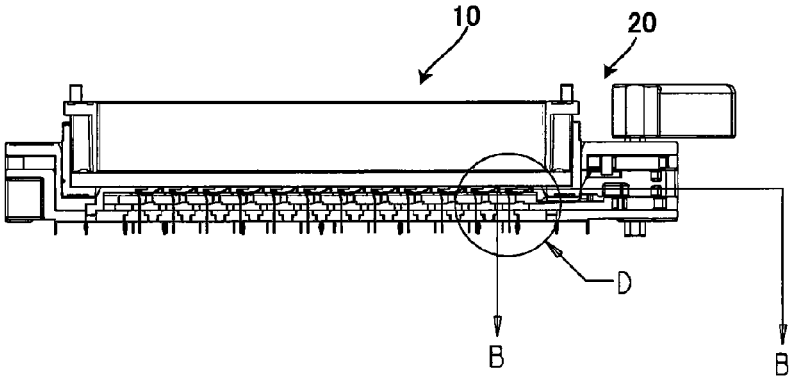

FIG. 8 (FIGS. 8(A) to 8(C)) are a plan view of a state before the lever is rotationally operated, shown in FIGS. 7(A) and 7(B), a partially-sectional plan view showing a portion in a section, and a vertical sectional view. Here, FIG. 8(C) is a sectional view taken along arrow A-A shown in FIG. 8(A). Further, FIG. 8(B) is a partially-sectional plan view showing a portion along arrow B-B shown in FIG. 8(C) in a section.

As shown in FIG. 8(B), the lock block 34 is slid to the right side in FIG. 8(B) according the distal end portion 341 pushed by the first connector 10 to be put in a shrunk state (shortened length) of the lock block spring 35. In this state, an abutting wall face 342 of the lock block 34 is spaced from a to-be-abutted wall face 363 of the cam member 36. That is, the cam member 36 is in an unlocked state, so that the cam member 36 can be rotated by operating the lever 37 rotationally.

When the first connector 10 is detached from the second connector 20, the lock block 34 is pushed by the lock block spring 35. The distal end portion 341 of the lock block 34 is put in a projecting state into the recess-shaped mating portion 202 (see FIG. 6). In this state, the abutting wall face 342 of the lock block 34 is caused to abut (be projected) on the to-be-abutted wall face 363 of the cam member 36. Thereby, the cam member 34 is put in a locked state, and even if the lever 37 is forced to be rotated, the rotation is blocked by the lock block 34.

Figure 9:
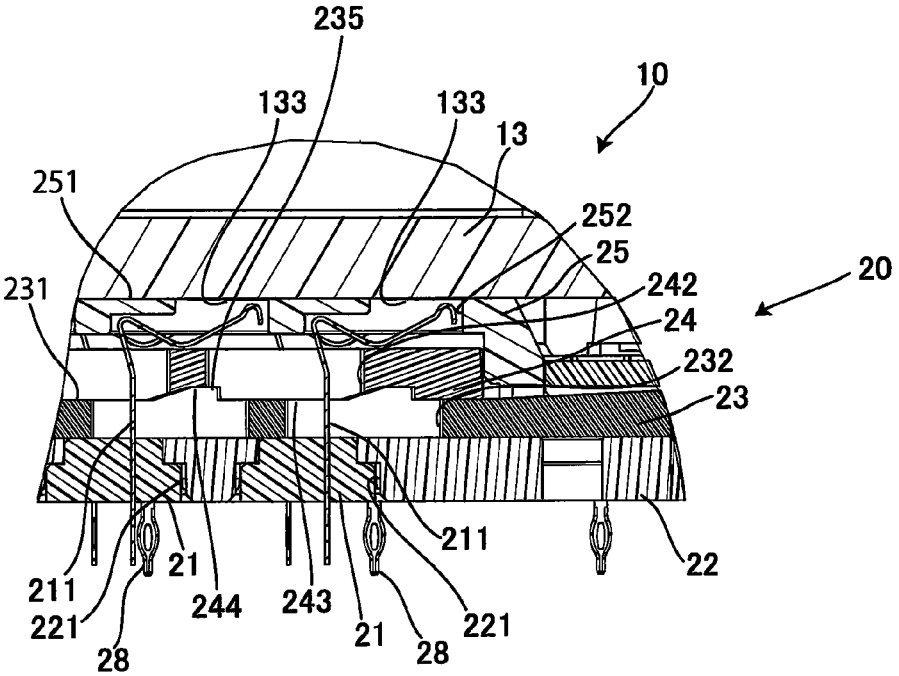
FIG. 9 is an enlarged view of a portion, surrounded by a circle D, of FIG. 8(C)

FIG. 9 is an enlarged view of a portion surrounded by a circle D shown in FIG. 8(C).

The contact block 21 is pressure-fitted into an elongated hole 211 of the base housing 22 from below the base housing 22. The contact 221 constituting the contact block 21 is protruded upward. The contact 221 penetrates the hole 232 of the slider 23 and the hole 242 of the lift plate 24, and an upper end portion thereof extends up to inside of the hole 252 of the upper housing 25. The circuit board 13 of the first connector 10 is located just above the upper housing 25. The contact pads 133 are formed on a lower face of the circuit board 13 facing the upper housing 25.

The upper face 231 of the slider 23 constitutes a cam face having many projecting portions 235. Further, the lower face 243 of the lift plate 24 also constitutes a cam receiving face having many recessed portions 244. (See FIG. 9.)

In the state shown in FIG. 9 (namely, in a state before the lever 37 is rotationally operated, shown in FIG. 7 (FIGS. 7(A) and 7(B))), the projecting portions 235 of the slider 23 enter the recessed portions 244 of the lift plate 24. In this state, a pushing-up force from the lift plate 24 does not act on the contact 221.

Figure 10A:
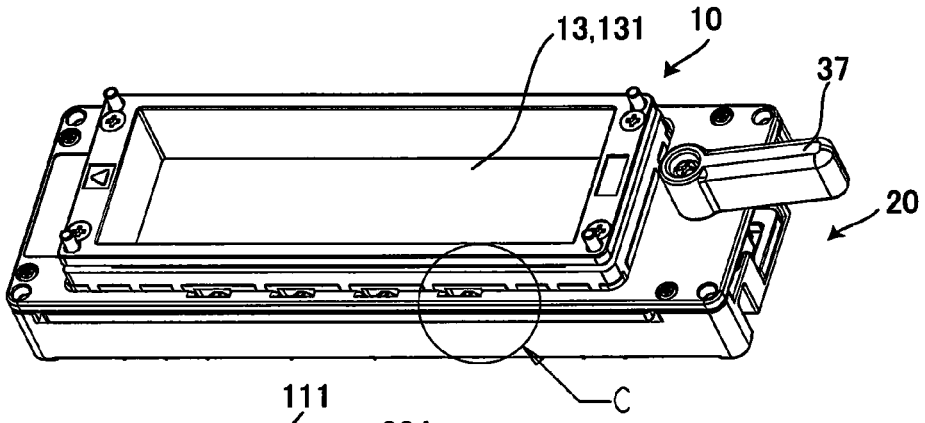
FIG. 10 shows perspective views of the lever rotated halfway (FIG. 10(A) and an encircled partially enlarged view thereof (FIG. 10(B))
Figure 10B:
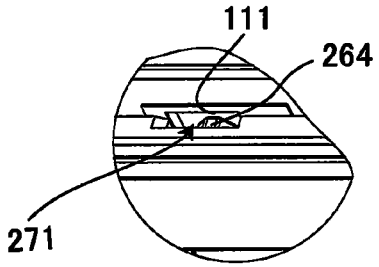

FIG. 10 shows a perspective view showing a state where the lever 37 has been rotated halfway (FIG. 10(A)) and a partially enlarged view of the state (FIG. 10(B)).

Here, FIG. 10(B) is an enlarged view of a portion surrounded by a circle C shown in FIG. 10(A).

Here, as shown in FIG. 10(A), the lever 37 is put in a state where it has been rotated halfway. In this state, as shown in FIG. 10(B), the lock projections 264 are put in halfway positions of the second portions 271*b* and 111*b* within the lock grooves 271 and 111 extending laterally. When the lock projections 264 move up to the position, the first connector 10 is already put in a locked state. That is, the first connector 10 cannot be detached from the second connector 20, and it is put in a fixed state in a mating state.

As described above, the cam projections 264 are provided on the lock plate 26 (see FIG. 5). The first cam 361 of the cam member 36 has entered the cam hole 263 of the lock plate 26. When the lever 37 is rotated, the cam member 36 is rotated integrally with the lever 37, so that the first cam 361 pushes a wall face of the cam hole 263 and the lock plate 26 is slid. That is, in the state where the lever 37 has been rotated halfway, shown in FIG. 10 (FIGS. 10(A) and 10(B)), the first cam 361 already acts on the lock plate 26, which means that the lock plate 26 is in a moving course.

Figure 11A:
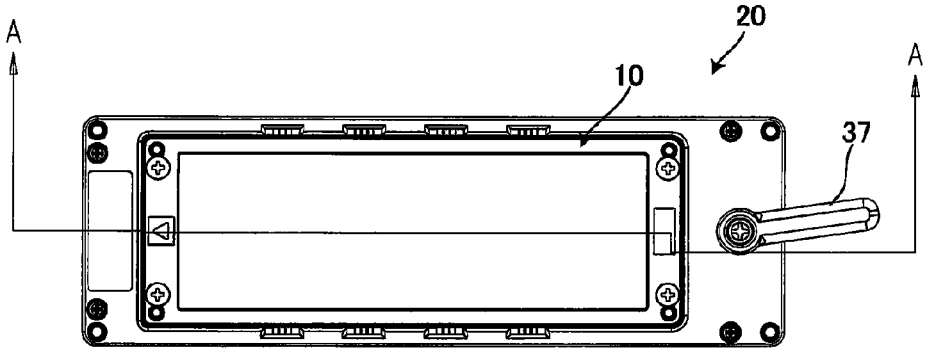
FIG. 11 shows a plan view (FIG. 11(A)) of the lever shown in FIG. 10 (FIGS. 10(A) and 10(B)) rotated halfway, a partially-sectional plan view thereof (FIG. 11(B)) showing a portion in a section, and a vertical sectional view therein (FIG. 11(C))
Figure 11B:
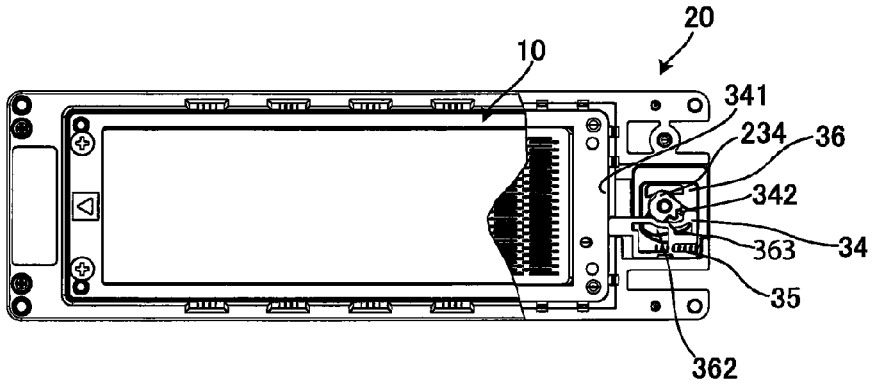
Figure 11C:
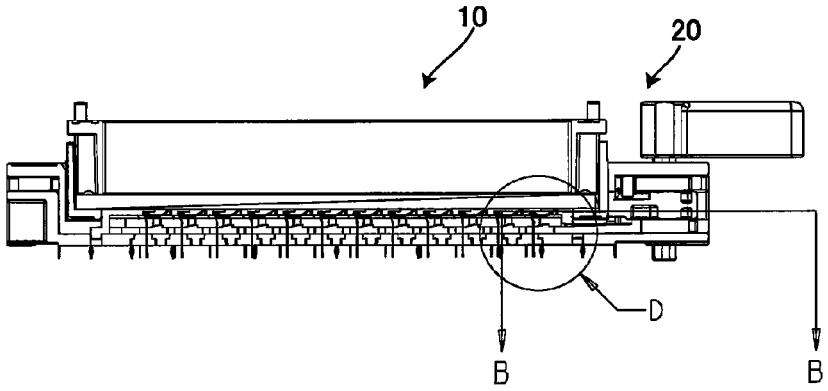

FIG. 11 shows a plan view of a state ((FIGS. 11(A) to 11(C)) where the lever 37 has been rotated halfway, shown in FIG. 10 ((FIGS. 10(A) and 10(B)), a partially-sectional plan view showing a portion of the state in a section (FIG. 11(B)), and a vertical sectional view (FIG. 11(C)), of the state. Here, FIG. 11(C) is a sectional view taken along arrow A-A shown in FIG. 11(A). Further, FIG. 11(B) is a partially-sectional plan view showing a portion along arrow B-B shown in FIG. 11(C) in a section.

As shown in FIG. 11(B), the cam member 36 is put in an unlocked state from locking performed by the lock block 34 like FIG. 8(B). However, in FIG. 11(B) the cam member 36 has been rotated from the state shown in FIG. 8(B). According to this rotation, the first cam 361 (see FIG. 5) acts on the lock plate 26 to slide the lock plate 26, thereby locking the first connector 10 in place.

As shown in FIG. 11(B), according to the rotation, the second cam 362 has been also rotated. However, in this stage, the slider 23 is not pushed by the second cam 362 yet, so that it does not start sliding.

Figure 12:
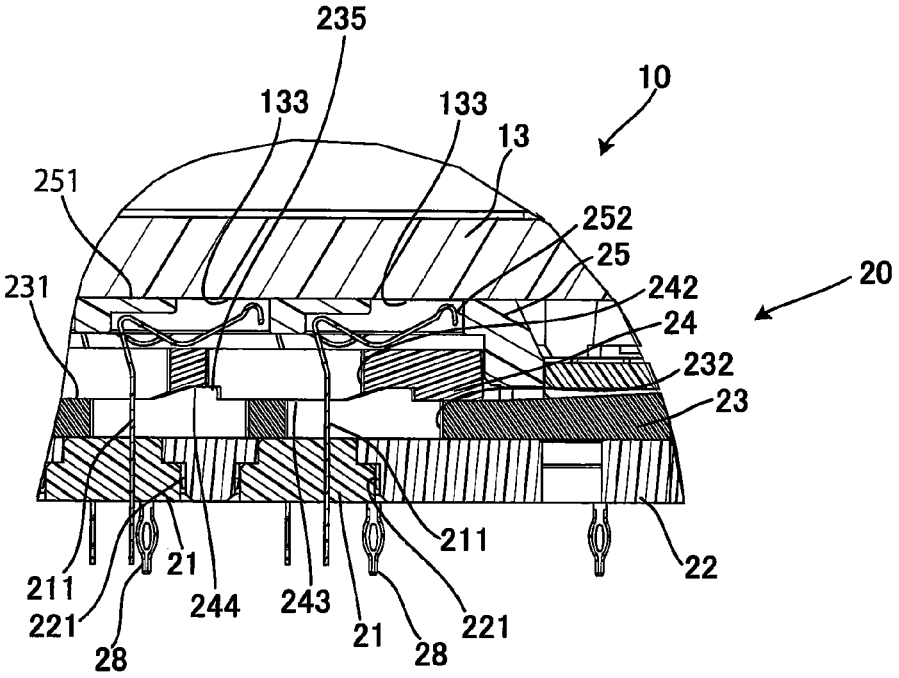
FIG. 12 is an enlarged view of a portion, surrounded by a circle D, of FIG. 11(C)

FIG. 12 is an enlarged view of a portion surrounded by a circle C shown in FIG. 11(C).

In a state where the lever 37 has been rotated up to an attitude as shown in FIG. 10 ((FIGS. 10(A) and 10(B)), the slider 23 does not start sliding. Therefore, the lift plate 24 has not been lifted up yet, so that the contact 221 remains in a state before being deformed.

Figure 13A:
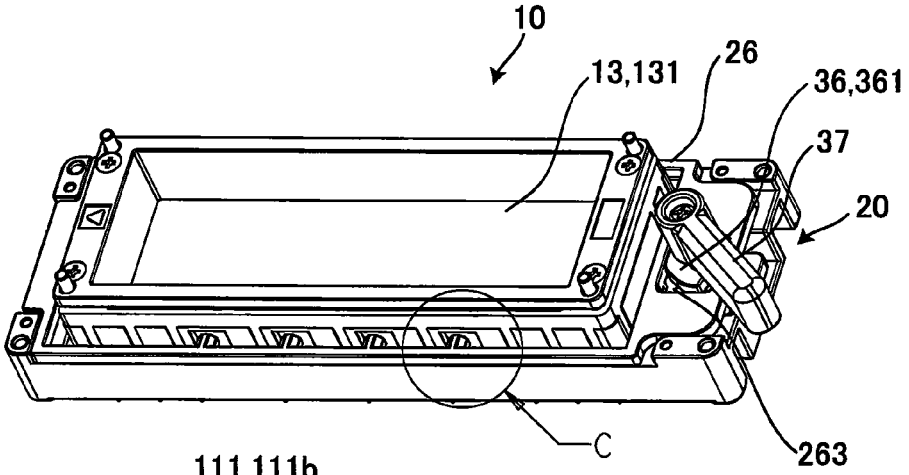
FIG. 13 shows perspective views of the lever rotated up to its final attitude (FIG. 13(A)) and a partially enlarged view thereof (FIG. 13(B))
Figure 13B:
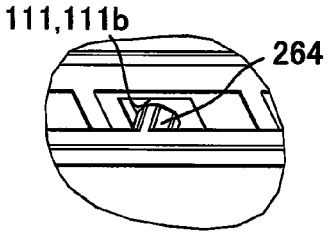

FIG. 13 shows perspective views showing a state where the lever has been rotated up to a final attitude (FIG. 13(A)) and a partial enlarged view of the state (FIG. 13(B)). Here, FIG. 13(B) is an enlarged view of a portion surrounded by a circle C shown in FIG. 13(A). Incidentally, in these FIGS. 13(A) and 13(B), a state where the shell 27 (see FIG. 5) has been detached is shown.

As shown in this FIG. 13 (FIGS. 13(A) and 13(B)), when the lever 37 is rotated up to the final attitude, the cam member 36 is also further rotated from the state shown in FIG. 10 (FIGS. 10(A) and 10(B)). The first cam 361 of the cam member 36 which has entered the cam hole 263 of the lock plate 26 further pushes the lock plate 26 so that the lock projection 264 is moved laterally up to a final position shown in FIG. 13. Thereby, the first connector 10 is locked to the second connector 20 more securely.

Figure 14A:
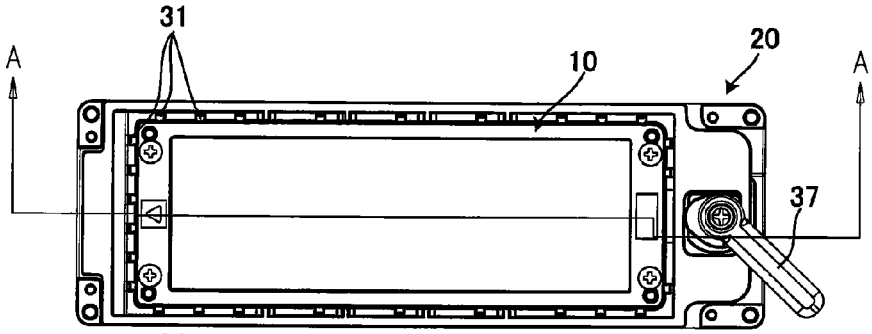
FIG. 14 shows a plan view of the lever shown in FIG. 13 (FIGS. 13(A) and 13(B)) rotated up to the final attitude (FIG. 14(A), a partially-sectional plan view thereof showing a portion in a section (FIG. 14(B)), and a vertical sectional view thereof (FIG. 14(C))
Figure 14B:
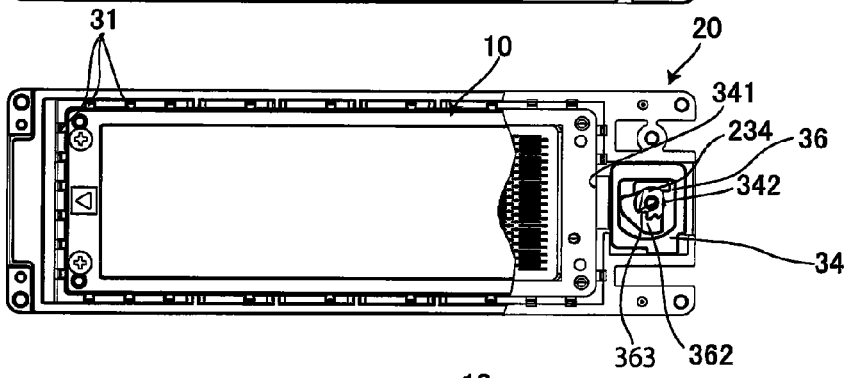
Figure 14C:
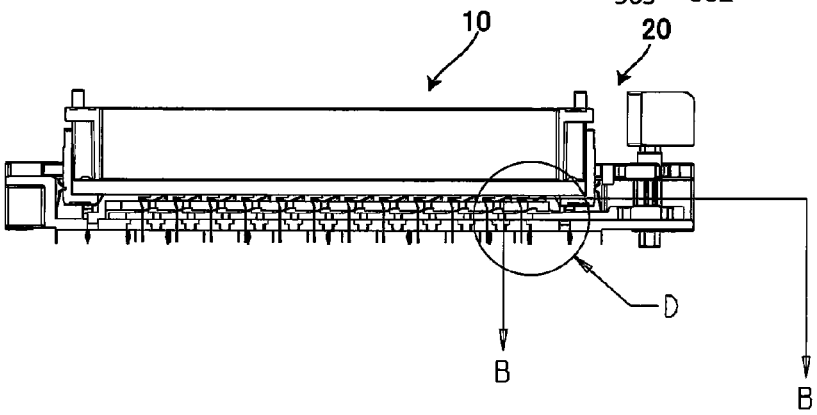

FIG. 14 shows plan views of a state where the lever has been rotated up to the final attitude (FIG. 14(A)), a partially-sectional plan view showing a portion of the state in a section (FIG. 14(B)), and a vertical sectional view of the state (FIG. 14(C)). Here, FIG. 14(C)) is a sectional view taken along arrow A-A shown in FIG. 14(A). Further, FIG. 14(B) is a partially-sectional plan view showing a portion along arrow B-B shown in FIG. 14(C)) in section. Even in this FIG. 14 (FIGS. 14(A) to 14(C)), a state where the shell 27 has been detached is shown like FIG. 13 (FIGS. 13(A) and 13(B)). Further, in FIG. 14 (FIGS. 14(A) to 14(C)), illustrations of the lock block 34 and the lock block spring 35 are also omitted.

When the lever 37 is rotated up to the final attitude, the cam member 36 is also rotated up to its final attitude. According to the rotation of the cam member 36, as shown in FIG. 14(B), the second cam 362 which has entered the cam hole 234 of the slider 23 pushes the slider 23 to slide the slider 23.

Figure 15:
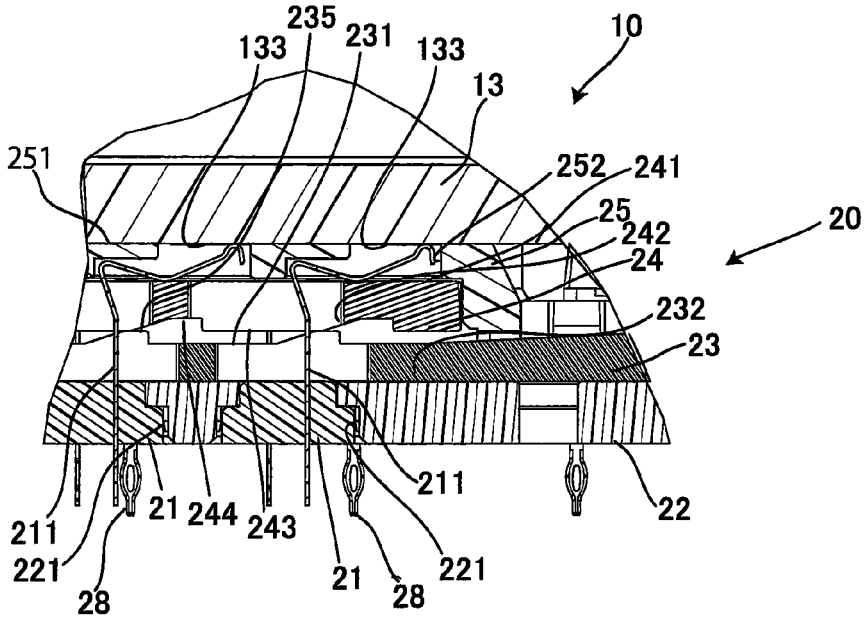
FIG. 15 is an enlarged view of a portion, surrounded by a circle D, of FIG. 14(C).

FIG. 15 is an enlarged view of a portion surrounded by a circle D shown in FIG. 14(C).

When the lever 37 is rotated up to the final attitude shown in FIG. 13 (FIGS. 13(A) and 13(B)), the slider 23 also slides in addition to the lock plate 26 which had previously started sliding. As a result, the projecting portions 235 on the cam face formed on the upper face 231 of the slider 23 overlap with the lower face 243 of the lift plate 23 so that lift plate 23 is lifted up. As a result, many contacts 221 arranged are simultaneously lifted up by the upper face 241 of the lift plate 24. The upper end portions of the contacts 221 have entered the holes 252 provided in the upper housing 25 and face the circuit board 13 of the first connector 10 just above the upper housing 25. The contact pads 133 are formed on the lower face of the circuit board 13 facing the upper housing 25. Therefore, the contacts 221 which have been lifted up by the lift plate 24 make contact with the contact pads 133 on the lower face of the circuit board 13 securely with a predetermined contact pressure. Here, many contacts 221 are simultaneously lifted up by one lift plate 24. Therefore, variations of the contact pressures or the contact timings can be suppressed as compared with a configuration in which individual contacts 221 are individually lifted up by the cam faces of the members corresponding to the slider 23 as disclosed by Sasaki in US 2014/0127922A1, for example.

Although several exemplary embodiments have been shown and described, it will be appreciated by those of skill in the art that various changes or modifications may be made in these embodiments without departing from the principles and spirit of the disclosure, the scope of which is defined in the claims and their equivalents.

What is claimed is:

1. A connector comprising:

a housing configured to be mated with a mating connector having a plurality of contact pads, the plurality of contact pads arranged on a mating face and expanding in a direction intersecting with a mating direction in a two-dimensional fashion;

a plurality of contacts arranged in a two-dimensional fashion and configured to make contact with the plurality of contact pads of the mating connector, respectively;

a slide plate having a cam face composed of a pattern of projections and recesses and expanding in a direction intersecting with the mating direction, and slid in a lateral direction intersecting with the mating direction according to a driving operation; and a moving plate expanding in an overlapping manner with the slide plate, receiving an action of the cam face caused by the sliding of the slide plate according to the driving operation to move toward the mating connector and pushing the plurality of contacts onto the plurality of contact pads of the mating connector.

2. The connector according to claim 1, further comprising a lock plate sliding in a lateral direction intersecting with the mating direction to fix a mating position of the mating connector to the housing according to the driving operation.

3. The connector according to claim 2, further comprising a cam member having a first cam portion sliding the lock plate to lock the mating connector according to the driving operation and a second cam portion sliding the slide plate to move the moving plate according to the driving operation and push the plurality of contacts onto the plurality of contact pads of the mating connector after locking of the mating connector performed by the lock plate.

4. A connector assembly, comprising:

a first connector comprising a first housing having a mating face comprised of a plurality of connection pads arranged in a two-dimensional fashion and extending in a direction intersecting with a mating direction; and a second connector having a second housing including a mating face configured to mate with the mating face of the first connector, a plurality of contacts arranged in a two-dimensional fashion to be mated with the mating face of the first connector, the plurality of contacts of the second connector brought into contact with the connection pads of the first connector with a driving force of a rotational operation of a lever on a first cam and a second cam, a slide plate having a cam face composed of a pattern of projections and recesses and extending in a direction intersecting with the mating direction, the slide plate slid in a lateral direction intersecting with the mating direction according to the rotational operation of the lever, and a moving plate overlapping the slide plate and receiving an action of the cam face caused by the sliding of the slide plate according to the rotational operation of the lever, the moving plate moving toward the first connector and pushing the plurality of contacts onto the plurality of connection pads.

5. The connector assembly according to claim 4, wherein the second connector further comprises a lock plate sliding in a lateral direction intersecting with the mating direction to fix a mating position of the first connector to the second housing according to the rotational operation.

6. The connector assembly according to claim 5, wherein the first cam slides the lock plate to lock the first connector according to the rotational operation and the second cam slides the slide plate to move the moving plate according to the rotational operation and push the plurality of contacts onto the plurality of contact pads of the first connector after locking of the first connector performed by the lock plate.

* * * * *